US005535878A

United States Patent [19]

Reed

[11] Patent Number: 5,535,878

[45] Date of Patent: Jul. 16, 1996

[54] RING HOLDER

[75] Inventor: Kenneth Reed, Pickering, Canada

[73] Assignee: Lawson Displays Limited, Markham, Canada

[21] Appl. No.: 445,043

[22] Filed: May 19, 1995

[51] Int. Cl.[6] ..... B65D 6/04

[52] U.S. Cl. ..... 206/6.1; 206/303; 206/493

[58] Field of Search ..... 206/6.1, 303, 493, 206/495; 248/176; 211/13

[56] References Cited

U.S. PATENT DOCUMENTS 4,880,117 11/1989 Garganese ..... 206/493 X 5,062,526 11/1991 Rudnick et al. ..... 206/6.1

*Primary Examiner*—Jacob K. Ackun

*Attorney, Agent, or Firm*—Schwegman, Lundberg, Woessner & Kluth

[57] ABSTRACT

Ring holder, usable with a conventional ring display, includes a body defining an upper face which in turn defines a notch or recess adapted to receive a portion of the ring. The notch has opposed flanks for engaging the outer surface of the ring at spaced locations, and a peg projecting above the support surface engages an inner surface of the ring, thus providing a stable support.

7 Claims, 3 Drawing Sheets

FIG. 5.
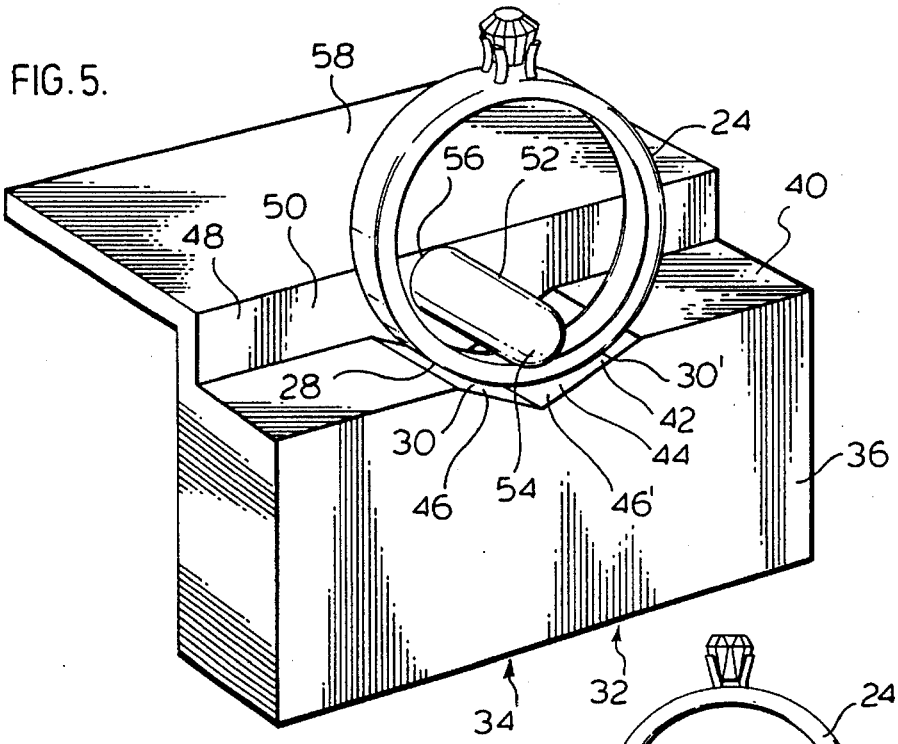
FIG. 6.
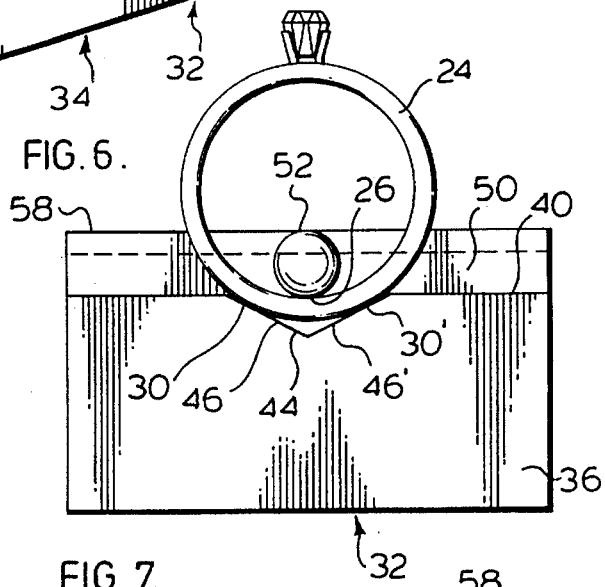
FIG. 7.
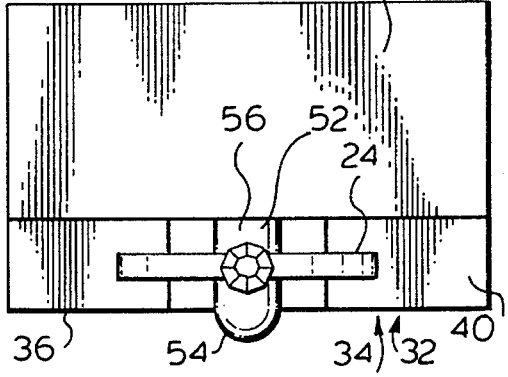
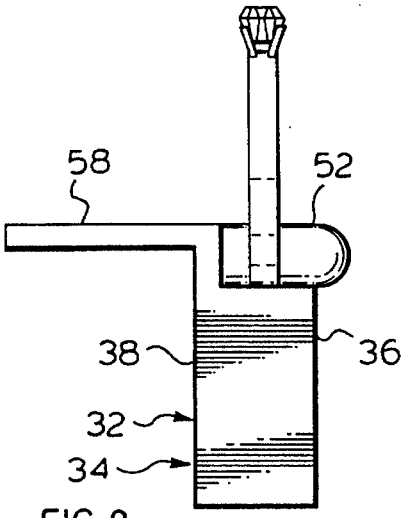
FIG. 8.

RING HOLDER

FIELD OF THE INVENTION

This invention relates in general to a ring holder and more particularly to a ring holder for use with a slotted ring display.

BACKGROUND OF THE INVENTION

Jewellery is usually bought in retail stores. Items such as rings are usually displayed in a glass case. Traditional ring displays use a series of slots into which the rings are inserted. Where the ring is provided with a precious stone in a setting, the setting and stone project above the slotted display but much of the ring is not visible thereby diminishing the visual impact of the entire ring upon the prospective purchaser.

Usually a small paper price tag is attached to the ring by a small string. The price tag is either tucked into the slot in the ring display, in which case it is not visible to the prospective purchaser or it is left on the surface of the ring display creating a disorganized and unsightly display.

Prior art ring holders have been devised to address the problem cited above.

U.S. Pat. No. 329,018 granted to T. S. Coffin on Oct. 27, 1885, provides a ring tray comprising a series of clamps which are adapted to slide vertically through apertures in the surface plate of the ring tray. The clamps are biased downwardly by a spring so as to engage the inner surface of the ring and bias the ring against the top of the tray. As a result, the ring is held in a position at right angles to the surface of the ring tray. A disadvantage of the Coffin ring tray is its complicated spring arrangement. The Coffin device does not disclose any mechanism for displaying the price of the ring in an efficient nor aesthetically pleasing manner.

U.S. Pat. No. 3,197,166 granted to H. R. Sandler on Jul. 27, 1965, provides for a ring holder comprising a metallic base and clamp which, by magnetic attraction, clamps the ring to the base in a vertical position. The Sandler patent does not disclose an efficient mechanism for displaying the price of the ring and requires the use of a non-traditional metallic base.

U.S. Pat. No. 4,646,920 granted to David B. Kruger on Mar. 3, 1987, discloses a jewellery display stand provided with a base member and a tab member for holding a ring by clamping the inner surface of the ring against the base member. The Kruger display also provides for a price tag retainer which is removably affixed to the base member. As contemplated by the Kruger patent, the ring display is self-supporting and is intended to rest on a flat surface. Nothing in the Kruger patent indicates that it can be used with a traditional slotted ring display.

Thus a ring holder which holds the ring in a vertical orientation and is adapted to be received by a traditional slotted display is desirable.

SUMMARY OF THE INVENTION

One aspect of the present invention is to provide an improved ring holder.

In accordance with one aspect of the present invention, there is provided a ring holder for use with a slotted ring display, the holder comprising a body provided with front and rear faces, said faces being adapted to be received by a slot in the ring display, said body being further provided with an upper face, a support surface provided on said upper face and having a notch to receive a portion of the ring. The notch has opposed flanks to engage the outer surface of the ring at spaced locations, and a peg projecting above the support surface to engage an inner surface of the ring thereby providing a stable support for the ring.

BRIEF DESCRIPTION OF THE DRAWINGS

A detailed description of the preferred embodiments is provided below with reference to the following drawings in which like numbers refer to like elements. In the drawings:

FIG. 5, in a perspective view, illustrates a ring holder in accordance with a second embodiment of the present invention;

FIG. 6, in a front view, illustrates the ring holder of FIG. 5;

FIG. 7, in a top view, illustrates the ring holder of FIGS. 5 and 6;

FIG. 8, in an end elevational view, illustrates the ring holder of FIGS. 5, 6 and 7;

DETAILED DESCRIPTION OF THE PREFERRED EMBODIMENTS

Figure 1:
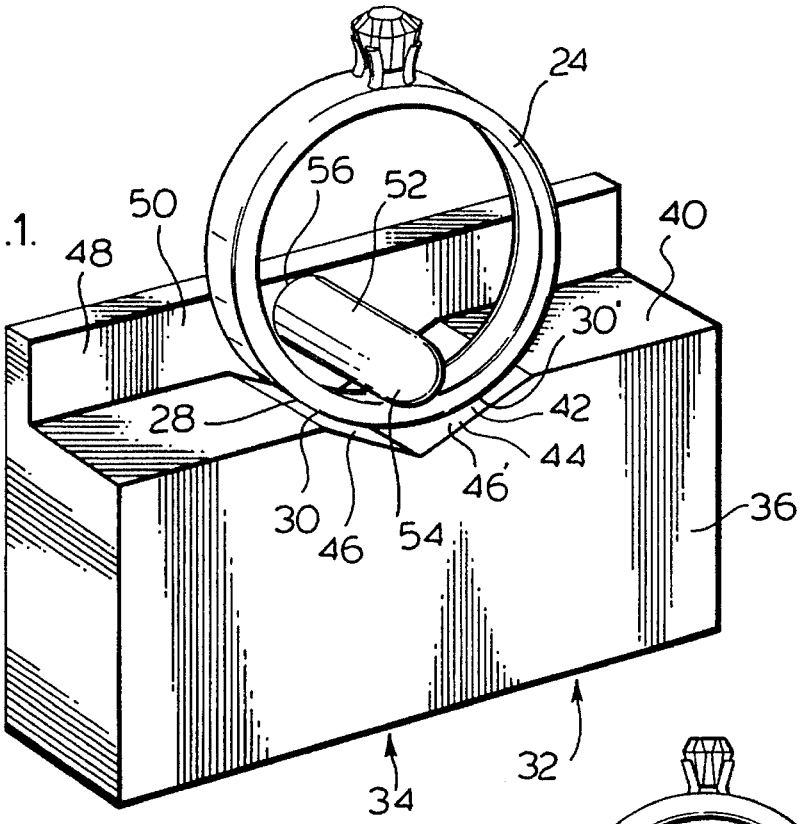
FIG. 1, in a perspective view, illustrates a ring holder in accordance with a first embodiment of the present invention while holding a ring in place.
Figure 2:
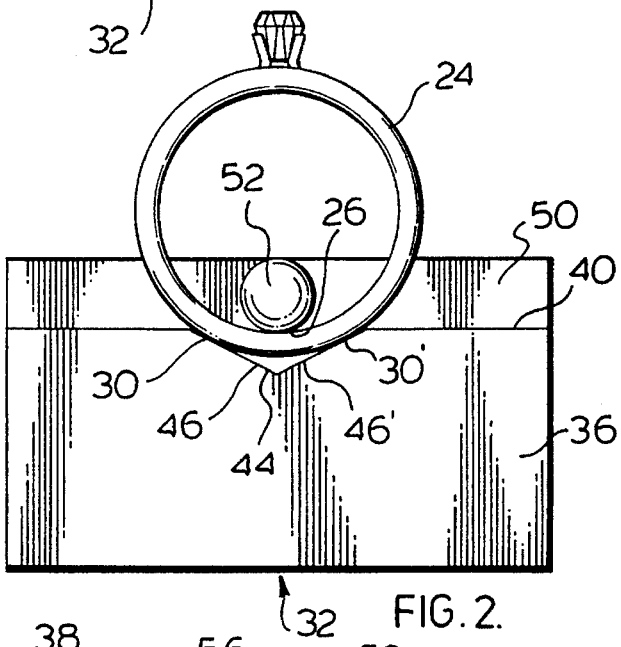
FIG. 2, in a front view, illustrates the ring holder of FIG. 1.
Figure 4:
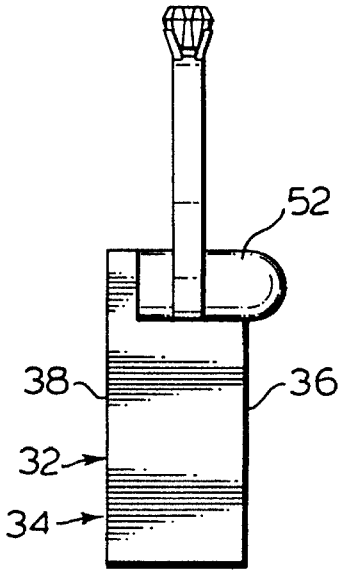
FIG. 4, in an end elevational view, illustrates the ring holder of FIGS. 1, 2 and 3.
Figure 3:
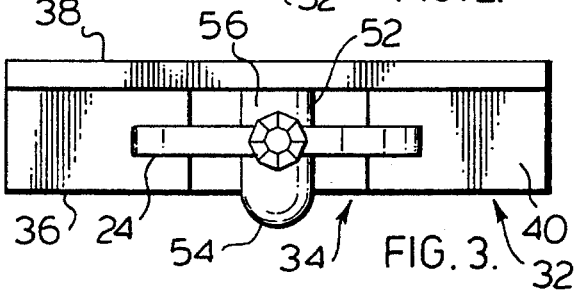
FIG. 3, in a top view, illustrates the ring holder of FIGS. 1 and 2.

Referring to FIGS. 1 to 4, there is illustrated, in a perspective view, a ring holder 32 in accordance with the first embodiment of the present invention. The ring holder 32 includes a body 34 having front face 36 and rear face 38. Faces 36 and 38 are adapted to be received by a slot in a traditional ring display. The body 34 also has an upper face 40 provided with a support surface 42.

The upper face 40 of the body 34 is provided with a step 48 which step has a front face 50. Peg 52 projects above the support surface 42. The peg 52 has a free end 54 and a root end 56. The root end 56 of the peg 52 is attached to the front face 50 of the step 48.

The upper face 40 has a notch 44 which has opposed flanks 46 and 46'.

When a ring 24 is placed in the ring holder 32, the opposed flanks 46 and 46' engage the outer surface 28 of the ring 24 at spaced locations 30 and 30' . Peg 52 engages the inner surface 26 of the ring 24. The three point contact provided by the ring holder creates a stable support for the ring 24 and holds the ring in an upright position.

FIGS. 5 to 8 illustrate a second embodiment of the present invention. The ring holder 32 is further provided with a label bearing surface 58 projecting rearwardly and horizontally from the upper portion of the rear face 38 of the body 34. The label bearing surface 58 is adapted to receive indicia relating to the ring 24 held by the ring holder 32. For example, the label bearing surface 58 could bear the model number of the ring and/or its price.

Figure 9:
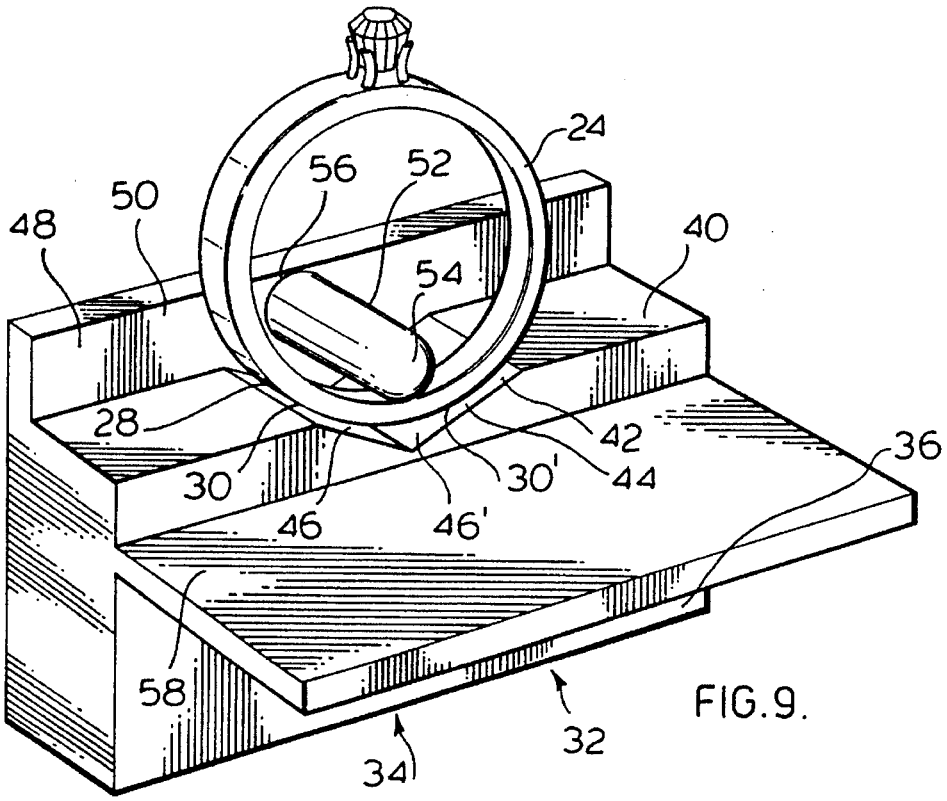
FIG. 9, in perspective view, illustrates a ring holder in accordance with a third embodiment of the present invention.

It will be appreciated that, in an alternative embodiment, the label bearing surface 58 could project from the front face 36 of the body 34, as illustrated in FIG. 9.

Figure 10:
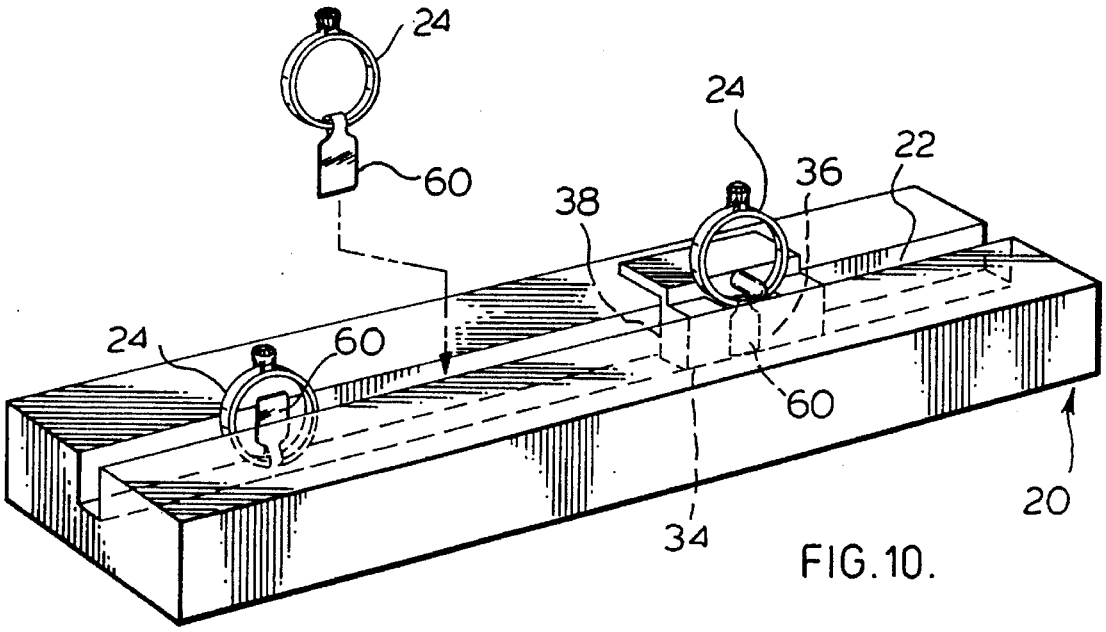
FIG. 10, in perspective view, illustrates a slotted ring holder used in a traditional manner and as used with a ring holder in the form of the second embodiment of the present invention.

As illustrated in the right had side of FIG. 10, the front face 36 and rear face 38 of the body 34 of the ring holder 32 are adapted to be received by the slot 22 of a slotted ring display 20. Price tag 60 may be used in the ring when used with the present invention.

The ring holder is preferably molded from clear resilient plastic but can be made from any material having sufficient structural rigidity to support a ring.

While three embodiments of this invention have been illustrated in the accompanying drawings and described above, it will be evident to those skilled in the art that changes and modifications may be made to these embodiments without departing from the essence of this invention. All such modifications or variations are believed to be within the sphere and scope of the invention as defined by the claims appended hereto.

The embodiments of the invention in which an exclusive property of privilege is claimed are defined as follows:

1. A ring holder for use with a slotted ring display, said holder comprising a body provided with front and rear faces, said faces being adapted to be received by a slot in the ring display, said body being further provided with an upper face, a support surface provided on said upper face and having a notch to receive a portion of the ring, said notch having opposed flanks to engage the outer surface of the ring at spaced locations, and a peg projecting above said support surface to engage an inner surface of the ring whereby a stable support is provided for the ring.

2. The ring holder of claim I wherein said upper face of said body is provided with a step, said step having a front face, and wherein said peg has a free end and a root end and said root end of said peg is attached to said front face of said step.

3. The ring holder of claim 2 wherein said flanks of said notch are substantially flat.

4. The ring holder of claim 2 wherein the free end of said peg is rounded.

5. The ring holder of claim 1, further comprising a label bearing surface projecting from a face of said body, said label bearing surface being adapted to receive indicia relating to a ring held by said holder.

6. The ring holder of claim 4 wherein said upper face of said body is provided with a step, said step having a front face, and wherein said peg has a free end and a root end and said root end of said peg is attached to said front face of said step.

7. The ring holder of claim 5 wherein the free end of said peg is rounded.

* * * * *